United States Patent [19]

Fowler et al.

[11] Patent Number: 4,744,508

[45] Date of Patent: May 17, 1988

[54] CONTINUOUS FORM MAILER ASSEMBLY

[75] Inventors: Terry J. Fowler, Grapevine, Tex.; Jill H. Gehrhardt, Centerville, Ohio

[73] Assignee: NCR Corporation, Dayton, Ohio

[21] Appl. No.: 5,178

[22] Filed: Jan. 20, 1987

[51] Int. Cl.[4] ..... B65D 27/06

[52] U.S. Cl. ..... 229/73; 229/69

[58] Field of Search ..... 229/73, 69, 68 R, 74

[56] References Cited

U.S. PATENT DOCUMENTS

| | | | |
|---|---|---|---|
| 3,905,545 | 9/1975 | Juszak et al. | 229/69 |
| 3,918,632 | 11/1975 | Neubauer | 229/69 |
| 3,942,714 | 3/1976 | Wise | 229/73 |
| 4,010,889 | 3/1977 | Allen et al. | 229/69 |
| 4,095,695 | 6/1978 | Steidinger | 229/69 |
| 4,277,016 | 7/1981 | Wakeman et al. | 229/69 |
| 4,343,430 | 8/1982 | Martineau | 229/69 |
| 4,384,670 | 5/1983 | Dicker | 229/69 |
| 4,418,865 | 12/1983 | Bowen | 229/69 |
| 4,586,611 | 5/1986 | Scalzo | 206/610 |

*Primary Examiner*—Willis Little

*Attorney, Agent, or Firm*—Wilbert Hawk, Jr.; Albert L. Sessler, Jr.; George J. Muckenthaler

[57] ABSTRACT

A mailer assembly has a front ply secured to a back ply adjacent the marginal portions of the two plies, and an intermediate ply extends to the edges of one side of the two plies with a line of adhesive between the front ply and the intermediate ply and a line of adhesive between the intermediate ply and the back ply. The intermediate ply is free along the other side of the front and back plies which are secured by dots of adhesive along such other side. The front ply has a removable tab portion to expose the intermediate ply which is removable from the front and back plies along said one side thereof.

8 Claims, 1 Drawing Sheet

CONTINUOUS FORM MAILER ASSEMBLY

BACKGROUND OF THE INVENTION

In the field of business forms, the continuous mailer is used in increasing quantities to provide means for processing and communicating data and to take advantage of newer forms of processing equipment. The business forms assume the shape of envelopes connected together by lines of weakening in a continuous assembly and have marginal portions with pin holes on the sides of the assembly for accommodating drive means to advance the continuous assembly through the processing equipment.

The continuous mailer generally includes a front ply and a back ply which are connected together to form an envelope and which contains at least one insert ply that provides printed data or information relative to the communicated business or like matter. Some forms of mailers may also include a return envelope which is a separate item from the front ply and back ply construction. Other forms of mailers are constructed to provide a portion of the front and back ply construction for use as a return envelope. One or more inserts may be included in the mailer with such insert(s) being connected to the front or back plies in certain forms or being free of the front or back plies in other forms.

Representative documentation in the field of continuous mailers includes U.S. Pat. No. 3,918,632, issued to F. H. Neubauer on Nov. 11, 1975, which discloses a front ply, a back ply, and an insert ply secured along at least two edges thereof to one of the front and back plies in order to form an insert packet. The back ply is secured to the front ply along three edges thereof.

U.S. Pat. No. 4,384,670, issued to D. Dicker on May 24, 1983, discloses a front ply, a back ply, and an intermediate ply secured to the back ply. A tab portion of the intermediate ply is secured to the front ply. The front ply is releasably secured to a body portion of the intermediate ply.

U.S. Pat. No. 4,418,865, issued to C. G. Bowen on Dec. 6, 1983, discloses a front ply secured to a back ply by lines of adhesive, and an insert ply free of attachment to the lines of adhesive.

U.S. Pat. No. 4,586,611, issued to A. C. Scalzo on May 6, 1986, discloses a front ply, a back ply, and an insert ply wherein one end is free of the mailer and the opposite end is secured to an edge region thereof.

SUMMARY OF THE INVENTION

The present invention relates to a continuous form mailer assembly. More particularly, the invention relates to an assembly having a front ply, an intermediate ply, and a back ply arranged to provide a mailing envelope, a message insert, and a return envelope. The invention is directed to a method for constructing a continuous mailer having a right side tab opening in the front ply, the insert ply being secured along the left margin of the mailer, and the back ply being formed to provide a return envelope.

The front ply and the back ply are connected and secured togeter by lines of adhesive and by spaced spots of adhesive, and the insert ply is connected to both the front and back plies along the left margins thereof. The tab portion of the front ply is connected to the marginal edge thereof by means of a line of weakening and the tab portion is connected to the back ply by means of a line of spots of glue adjacent the line of weakening. A second line of weakening is provided toward the center of and spaced from the first line of weakening to enable the tab portion to be easily removed from the front ply by the recipient of the mailer.

The insert ply includes a line of weakening along the left margin of the mailer to permit the insert ply to be easily removed from the mailing envelope by the recipient. The back ply includes a right hand portion which is foldable over a portion of the front ply and includes a line of remoistenable glue to seal the return envelope.

In view of the above discussion, a principal object of the present invention is to provide a continuous form mailer assembly that is convenient to use by the sender and by the recipient.

Another object of the present invention is to provide a tab opening along one side of the front ply of the mailer to expose the insert ply and to enable folding of the back ply for use as a return envelope.

An additional object of the present invention is to provide an insert ply in a mailer assembly that is connected along one margin of the assembly for exact registration with both the front ply and the back ply.

A further object of the present invention is to provide a mailer assembly having a removable front ply portion to enable exposure of the insert ply, the insert ply being easily removable from the margin thereof, and the back ply having a portion foldable for use as a return envelope.

Additional advantages and features of the present invention will become apparent and fully understood from a reading of the following description taken together with the annexed drawing.

DESCRIPTION OF THE PREFERRED EMBODIMENT

Figure 1:
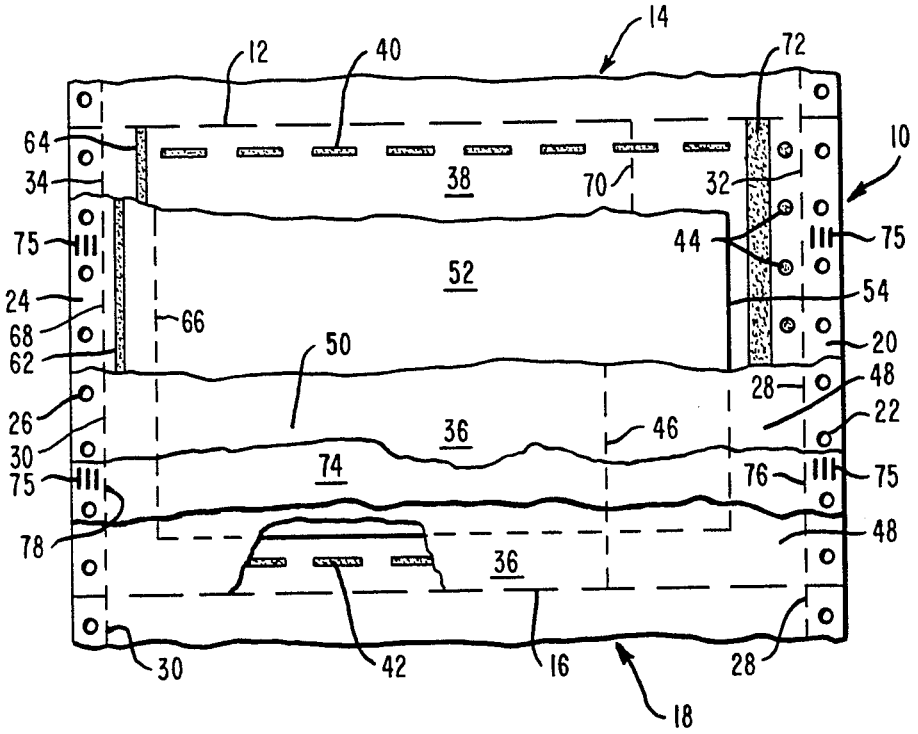
FIG. 1 is a top plan, partial broken-away, view of the mailer assembly of the present invention.
Figure 2:
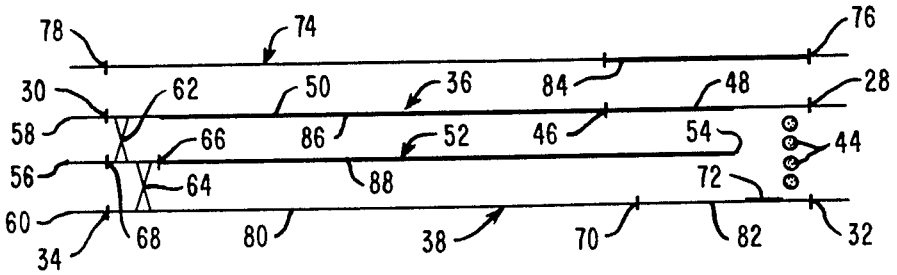
FIG. 2 is an end view in exaggerated form of the mailer assembly.

Referring now to FIGS. 1 and 2, the mailer assembly, generally shown as 10, is one mailer assembly in a series of connected mailer assemblies comprising a continuous business form wherein a line of weakening 12 connects the assembly 10 with an adjacent mailer assembly 14 and a line of weakening 16 connects the assembly 10 with an adjacent mailer assembly 18.

A right hand margin 20 (FIG. 1) is provided with pin holes 22 and a left hand margin 24 is provided with pin holes 26 for driving the continuous business form in processing transactions. The margins 20 and 24 are connected to the main portion of the mailer assembly 10 by means of lines of weakening 28, 30, 32, and 34, respectively, (FIG. 2) the margins being easily removable by the sender of the mailer assembly after the desired information is placed in the appropriate locations of the mailer assembly, as by printing operation.

The mailer assembly 10 includes a top or front ply 36 of rectangular shape and a bottom or back ply 38 of the same size as the front ply and secured thereto by means of adhesive or glue which is preferably in the form of interrupted lines 40 and 42 (FIG. 1) adjacent the edges of the top and bottom plies and along and spaced from the lines of weakening 12 and 16, respectively. The top ply 36 and the bottom ply 38 are also connected by a line of spaced spots 44 of adhesive (FIG. 2) adjacent the lines of weakening 28 and 32.

The top ply 36 has a line of weakening 46 spaced from the line 28 to provide and form a tab portion 48 which occupies about one-third of the top ply at the right hand side thereof and which is easily removable by the recipient of the mailer assembly 10. The tab portion 48 is removable along the line of weakening 28 from the margin 20 and from the body 50 (FIG. 2) of the front ply 36 along the line of weakening 46. A small aperture (not shown) is provided at the top of the tab portion 48 at the line of weakening 46 to enable easy removal of the tab portion.

An insert ply 52 is provided between the top ply 36 and the bottom ply 38 of the mailer assembly 10 and is smaller in size than such plies. The right hand edge 54 of the insert ply 52 is spaced from the line of glue spots 44 and the left hand edge 56 extends to the left edges 58 and 60 (FIG. 2) of the front and back plies 36 and 38, respectively. The insert ply 52 is connected to the top ply 36 by means of a continuous line 62 of adhesive located just inside the left hand margin 24 and the insert ply 52 is also connected to the bottom ply 38 by means of a continuous line 64 of adhesive located to the right of the line 62 and adjacent a line 66 of weakening in the insert ply. A line of weakening 68 is provided in the insert ply 52 and is aligned with lines 30 and 34 in the top and bottom plies, respectively.

The bottom ply 38 has a line 70 of weakening about one-third of the width of the ply from the right side thereof and located to the right of the line 46 in the top ply 36. The bottom ply 38 also has a continuous line 72 of remoistenable glue on a side portion 82 for sealing the return envelope. The bottom ply 38 includes a body portion 80 occupying the space between the line 70 of weakening and the line 34 of weakening and includes the side portion 82 occupying the space between the lines 32 and 70 which side portion is exposed after removal of the tab portion 48. The side portion 82 includes printed instructions on the face thereof for using the mailer assembly.

In the use of the mailer assembly 10 of the present invention, a cover 74 includes certain printed information, all or a portion of which is repeated on the face of the insert ply 52 and on the face of the bottom ply 38. The cover 74 is attached to the top ply 36 and to the bottom ply 38 by means of crimping in the form of paper staples 75 in the margins 20 and 24. The cover 74 provides a record copy of the communication for the sender of the mailer assembly 10. The cover 74 also includes lines 76 and 78 of weakening along the margins 20 and 24, respectively and, of course, the cover 74 includes the pin holes 22 and 26 corresponding to those in the top and bottom plies 36 and 38. The back of the cover 74 is spot coated in the lower right hand corner thereof with hot wax carbon 84 to provide means for transferring the printing in the form of an image onto the face of the top ply 36 or onto the front of the sending unit. The back of the top ply 36 and the back of the insert ply 52 are coated as at 86 and 88, respectively, over substantially the entire surfaces thereof for transferring the printed image onto the face of the bottom ply 38. The hot wax carbon coating, as at 84, 86 and 88, is indicated as a heavy line to show the extent of such coating on the cover 74, the top ply 36 and the insert ply 52.

Upon receipt of the mailer assembly 10, the recipient opens the mailer by grasping the tab portion 48 at the top thereof and pulling down along the lines 28 and 46 of weakening and separating the tab portion from the bottom ply by releasing of the spots 44 of adhesive along the right margin 20. The insert ply 52 is then grasped at the right side thereof and is snapped out from the line 66 of weakening adjacent the glue line 64 at the left side of the mailer. The insert ply 52 is retained by the recipient for record purposes. The body portion 50 of the top ply 36 and the body portion 80 of the bottom ply 38 make up the envelope for return mailing. A check or other payment is placed in the return envelope and the right hand or side portion 82 of the bottom ply 38 is folded along the line 70, after moistening of the glue line 72, to seal the return envelope.

It is thus seen that herein shown and described is a business form that serves as a mailer assembly and provides a simple and convenient arrangement with an insert ply that is connected to be in registration with the top and the bottom plies. The arrangement enables the accomplishment of the objects and advantages mentioned above, and while a preferred embodiment has been disclosed herein, variations thereof may occur to those skilled in the art. It is contemplated that all such variations and modifications not departing from the spirit and scope of the invention hereof are to be construed in accordance with the following claims.

We claim:

1. A mailer assembly comprising a front ply for receiving information thereon, said front ply including a body portion and a removable tab portion adjacent the body portion, said front ply having coated means for transferring information, a back ply connected to said front ply along the side, top and bottom edges thereof to provide a pocket between the front and back plies, said back ply including a body portion for receiving information thereon and including a side portion having printed use instructions thereon and exhibited after removal of the tab portion from the front ply, and an insert ply between the front and back plies and having coated means for transferring information onto said back ply, said front ply and said back ply each having a line of weakening at one side of the mailer assembly to define a marginal portion, and the front ply, the insert ply and the back ply each having a line of weakening at the other side of the mailer assembly to define a marginal portion, said insert ply being free of attachment to the front and back plies at one side thereof and extending to the edges of the front and back plies and being connected inwardly of the marginal portion at said other side of the mailer assembly with lines of adhesive positioned in offset manner to the front and back plies at the opposite side from said one side thereof, said insert ply having a line of weakening inwardly of the connection thereof with the back ply whereby the insert ply is removable with respect to the top and bottom plies, the side portion of said back ply being folded over the front ply for providing a return envelope assembly.

2. The mailer assembly of claim 1 wherein the coated means for transferring information comprises a coating on the back side of the front ply and a coating on the back side of the insert ply.

3. The mailer assembly of claim 2 wherein the coating on the back side of the front ply substantially covers the body portion thereof and extends into the tab portion of the front ply, and the coating on the back side of the insert ply covers substantially the entire surface thereof.

4. The mailer assembly of claim 1 wherein the means for connecting the front ply to the back ply comprises a line of releaseable glue spots adjacent the marginal portion at one side of the mailer assembly and a line of interrupted adhesive adjacent each of the top and bottom edges of the respective front and back plies.

5. The mailer assembly of claim 1 including a first line of adhesive inwardly of the one marginal portion at said other side of the mailer assembly for connecting the insert ply to the front ply and a second line of adhesive inwardly of the first line of adhesive and outwardly of the line of weakening enabling removal of the insert ply, for connecting the insert ply to the back ply.

6. The mailer assembly of claim 1 wherein the front ply includes a line of weakening spaced from the one marginal portion enabling removal of the tab portion and the back ply includes a line of weakening closer to the said one marginal portion for enabling folding of the side portion of the back ply over the body portion of the front ply.

7. The mailer assembly of claim 1 including a cover attached to the front ply and providing a record of the information contained in the mailer assembly.

8. The mailer assembly of claim 1 wherein the lines of weakening in the front ply, the insert ply and the back ply at said other side of the mailer assembly are aligned to define the marginal portion, and the line of weakening in the insert ply enabling removal thereof from the front and back plies is spaced from the aligned line of weakening in the insert ply, and the insert ply is secured to the front ply and to the back ply in offset manner by means of lines of adhesive positioned between the lines of weakening in the insert ply.

* * * * *